US007183899B2

(12) United States Patent
Behnke

(10) Patent No.: US 7,183,899 B2
(45) Date of Patent: Feb. 27, 2007

(54) REMOTELY MONITORED AND CONTROLLED BUILDING AUTOMATION SYSTEM

(75) Inventor: Walter C. Behnke, Blackwood, NJ (US)

(73) Assignee: Global Gate Technologies, Inc., Erdenheim, PA (US)

( * ) Notice: Subject to any disclaimer, the term of this patent is extended or adjusted under 35 U.S.C. 154(b) by 290 days.

(21) Appl. No.: 10/800,894

(22) Filed: Mar. 15, 2004

(65) Prior Publication Data

US 2005/0200474 A1 Sep. 15, 2005

(51) Int. Cl.
*G09F 25/00* (2006.01)

(52) U.S. Cl. ..... 340/286.01; 340/506; 700/276; 702/62

(58) Field of Classification Search ..... 340/506, 340/521, 531, 540, 286.01; 700/276; 236/51; 707/102; 702/62
See application file for complete search history.

(56) References Cited

U.S. PATENT DOCUMENTS

| | | | | |
|---|---|---|---|---|
| 4,153,945 | A * | 5/1979 | Actor et al. | 714/47 |
| 6,157,943 | A | 12/2000 | Meyer | |
| 6,487,457 | B1 | 11/2002 | Hull et al. | |
| 6,571,140 | B1 | 5/2003 | Wewalaarachchi | |
| 6,598,056 | B1 | 7/2003 | Hull et al. | |
| 7,053,767 | B2 * | 5/2006 | Petite et al. | 340/531 |
| 2001/0010032 | A1 * | 7/2001 | Ehlers et al. | 702/62 |
| 2002/0095323 | A1 * | 7/2002 | Combs et al. | 705/8 |
| 2002/0097150 | A1 * | 7/2002 | Sandelman et al. | 340/506 |
| 2002/0125998 | A1 * | 9/2002 | Petite et al. | 340/286.01 |
| 2005/0198063 | A1 * | 9/2005 | Thomas et al. | 707/102 |

* cited by examiner

*Primary Examiner*—Brent A. Swarthout
(74) *Attorney, Agent, or Firm*—Richard L. Strauss, Esq.

(57) ABSTRACT

A remotely monitored and controlled building automation system is disclosed providing efficient offsite use of BAS personnel to monitor and control such systems while utilizing relatively inexpensive alarm monitoring services to advice of system emergencies. In a first preferred embodiment, the building automation system transmits a simplified BAS/energy alarm (including only building identity information) via a specially adapted and configured local security panel to an offsite monitoring center. Thereafter, the alarm is re-transmitted to a BAS web server and on to a BAS website. The BAS website provides notification of the energy alarm to trained BAS technicians located at a remote dealer and enables such personnel, via the website to maintain two-way communication with the building automation system from which the alarm originated. Such personnel are thereby enabled to fully analyze and properly respond to the circumstances which resulted in the alarm. In a second preferred embodiment, the building automation system transmits the simplified BAS alarm directly to a security monitoring center. A BAS controller is disclosed, especially configured and adapted to generate an "energy alarm" upon reception of sensor data indicating the existence of conditions beyond programmed parameters and to provide two way communication of detailed BAS data between the controller and an offsite location. In addition, an especially configured and adapted security panel is disclosed, including a specially coded sensor position, whereby reception of a simplified BAS alarm by the security panel is recognized and re-transmitted to a monitoring center as an energy alarm.

56 Claims, 2 Drawing Sheets

REMOTELY MONITORED AND CONTROLLED BUILDING AUTOMATION SYSTEM

TECHNICAL FIELD

The present invention relates to the arts of computerized automation and control. More specifically, the disclosed system and devices relate to computerized building automation systems.

BACKGROUND OF THE INVENTION

Large commercial buildings often utilize many complex environmental control systems such as, for example, heating, cooling, ventilation and lighting systems as well as devices utilized to control humidity and air purity. These devices may be at least partially integrated into an HVAC system—a system that combines heating, cooling and ventilation—. In other instances, separate systems may provide each of these functions. Such buildings also often require more than one of the afore-mentioned devices to service the entire premises. In addition, desired environments provided by heating, cooling, ventilation, air purity, and lighting devices may vary in accordance with time of day, area of the building concerned, and whether or not the area is occupied at any given time.

Modern HVAC systems providing the aforementioned functions, as well as individual devices providing any one function, require complicated controls to provide desired environments throughout a building. In addition, such devices require both periodic maintenance (e.g. filters, lubrication) to maximize equipment life, as well as service in the event of device failures. Modern BAS (building automation systems) comprise well known electronic devices utilized to perform the aforementioned control of building devices as well as to provide alerts when building devices, monitored by such systems, require service. Such devices typically include a BAS controller, also commonly known as a master panel, which is programmed with software allowing such devices to provide efficient and cost effective building climate control by, for example, providing accurate set point activation and deactivation of HVAC and/or independent building heating, cooling, ventilation, and lighting devices. Such systems, although utilizing software to control building environmental conditions, also typically include adaptive demand-side control allowing variation from programmed parameters when desired. In addition, modern building automation systems provide detailed alert codes for each and every condition detected such as, for example, the need for monitored device maintenance, repair and failure. Such alerts are typically provided to "front end" computers monitored by onsite BAS/HVAC technicians. BAS technicians monitor such systems for the afore-mentioned alerts, as well as to modify software algorithms so as to improve energy management.

Although the aforementioned building automation systems may be highly useful and efficient for large commercial buildings, such systems are not practical for smaller buildings or private homes. The cost of onsite monitoring of front end computers by a BAS technician employed to provide such services is often too costly for such smaller premises.

Remote monitoring of building automation systems by a central monitoring service would also be costly. Present BAS technology would require such monitoring services to employ BAS technicians to monitor such systems 24 hours a day even when their expertise, in regard to codes requiring immediate expert intervention and/or decisions, would not be required.

More specifically, each BAS system is programmed to detect an entire range of conditions of monitored and controlled equipment. Each condition detected by the BAS is represented by a unique trouble code. A central BAS center would receive all of the complex and varying codes generated by different makes and models of BAS controllers. The codes received would vary in accordance with the make and model of BAS reporting the alert as well as the nature of the event which had occurred. Codes, requiring the prompt intervention of a BAS technician, as well as routine BAS data would both require that such centers employ costly BAS technicians to interpret the nature of such codes. In addition, the amount of data included in such complex alerts requires broadband transmission—whether transmitted to a front end computer or a remote monitoring center—. Therefore, remote monitoring centers would require connection directly into a primary building network to receive the code stream. Thus, central monitoring of existing building automation systems would still not provide substantial, if any, reduction in the cost of operating such systems.

Smaller commercial building and homes can, and often do utilize security systems which are monitored by an offsite security monitoring center. Such systems typically include a security controller which monitor and are in electronic communication with, for example, security sensors (such as motion, window and door switches), and fire sensors. Such security controllers are often configured for communication with a panic switch (often being a remote transmitter utilized to transmit a health or security alert). When any of the afore-mentioned sensors or switches are activated, a signal is sent via hard wire or wireless means to the security controller. The security controller receives the signal and then transmits the alarm, via a communications board within the controller, to a security monitoring center. Such transmission is most often accomplished via a telephone modem and an ordinary telephone line.

The alarm transmitted by the security controller to the security monitoring center includes the location of the premises transmitting the alarm. In addition, many such systems transmit the type of alarm being sent (e.g. security, fire, panic). Such systems provide such differentiation in alarm by assigning different sensor addresses and/or codes to each type of sensor and then transmitting such address and/or code information to the monitoring center.

Security monitoring centers are staffed with individuals, who, upon receipt of any of the afore-mentioned security, safety or panic (also referred to as "life") alarms, place a call to the reporting premises to verify the alarm (obviate the occurrence of a false alarm) and, when indicated, also call fire, police or medical personnel to alert them of the related situation. Although such security personnel are sufficiently trained to respond to such fire/life/safety alarms via telephone calls, they certainly do not have the advanced technical training required of BAS technicians who must not only understand the function and maintenance complicated building systems and devices but also be able to comprehend BAS codes. BAS technicians receive specialized training enabling such personnel to analyze, diagnose and respond to complicated BAS data, alter BAS software algorithms, and otherwise make expert decisions regarding the efficient and cost effective management of highly complex building environmental systems.

SUMMARY OF THE INVENTION

Now, in accordance with the present invention, a remotely monitored and controlled building automation system is disclosed. In a first preferred embodiment of the present invention, the building automation system is comprised of a BAS controller, at least one remote node, a security system board, security monitoring center, a BAS web server, a BAS website and an authorized dealer.

The BAS controller of the first preferred embodiment includes a computer processor, building management software, a data storage means, power supply, remote node communications interface, alarm communications interface and at least one remote communications interface. However, it is contemplated that each such communication interface may utilize shared communication hardware and software in providing such communication functions. The terms BAS CONTROLLER, BAS MASTER PANEL, BAS MANAGEMENT CONTROLLER and BAS FRONT PANEL, as utilized throughout this specification and within the claims are equivalent and interchangeable terms referring to the onsite building management controller including the processor, building management software, data storage means, power supply and communications interfaces described immediately above and below.

The BAS controller's processor is especially configured and adapted via customized software to generate and transmit a simplified BAS alarm—consisting of data indicating only the location of the subject building and that an energy (BAS) alarm has occurred—to a security monitoring center via the alarm communications interface in response to reception of sensor data indicating the existence of a monitored condition or device is operating beyond acceptable parameters. The term "beyond acceptable parameters" as utilized throughout this specification and within the claims refers to sensor data indicating a device failure, the likelihood of imminent device failure, need for immediate device servicing, or that an environmental condition such as, for example, temperature, humidity, or air purity that has exceeded a set limit. Such simplified BAS alarms are not generated in response to ordinary changes in environmental conditions requiring normal device operation such as, for example, a decrease in temperature requiring activation of a boiler. Simplified BAS alarms would be generated, for example, by sensor data indicating a clogged filter, low lubricant level, or overheat condition of a monitored device—conditions which required immediate attention in order to avoid substantial damage—.

BAS controllers of the present invention include BAS software especially configured and adapted to cause the BAS processor, upon receipt of sensor data indicative of a myriad of individual and problem specific alarm condition codes, to generate a simple generic cod—the simplified BAS alarm—while storing all of the specific condition data within the BAS controller database.

In the first preferred embodiment of the present invention, the BAS controller transmits a simplified BAS alarm to a security system board located within the same premises via, for example, a dry contact closure. More specifically, the alarm communications interface of the BAS controller communicates with a local security system board via, for example, a hard wired or wireless means to deliver a simple pulse to a designated alarm switch position on the security board. The security panel (which is also referred to throughout this specification and claims, interchangeably, as a security system board or security control board) is especially configured and adapted to "recognize" the simplified BAS alarm as a sensor with the address "energy alarm" or "BAS alarm". More specifically, the security system board communications interface enabling receipt of the simplified BAS alarm may, for example, comprise a specially coded switch position located on the security control board which is coded "energy alarm" or "BAS alarm." Thus, in certain preferred embodiments of the present invention, the simplified BAS alarm signal sent to the security system board is received in the same manner as an open window, open door or other security switch signal. Thus, only the designation of a switch position within a security system board is required—in addition to coding of the switch position as "energy alarm"—in order to integrate existing security system boards into the present system. The security system board utilizes a remote communication interface to transmit the simplified BAS alarm to the security monitoring center in the same manner as any other alarm. However, since the switch position has been coded as an energy alarm, the security monitoring center receives the alarm as such.

The security monitoring center also includes a communications interface enabling receipt of the simplified BAS alarm and thereafter re-transmission of same to a BAS web server. In order to facilitate efficient reception and re-transmission of the simplified BAS alarm, in certain preferred embodiments of the present invention, the security center includes monitoring software especially configured and adapted to automatically pass the simplified BAS alarm on to the BAS web server. However, both communication functions (reception and transmission of BAS alarms) may be provided by common communication hardware and software.

The BAS controller's one remote communications interface enables two way communication of detailed BAS sensor and control data between the controller and an off site location such as, for example, a BAS web site. Therefore, the BAS controller enables remote, offsite control of all BAS controlled devices. These functions are discussed in greater detail, below.

In the first preferred embodiment of the present invention, the at least one remote node includes a power source, at least one sensor especially adapted and configured to monitor a BAS device or building environmental condition (e.g. temperature, humidity, light), and a processor. The node also includes a communications interface enabling transmission of sensor data from the node to the BAS controller and, in certain preferred embodiments, transmission of data from the controller back to the remote node.

The BAS web server of the present invention includes at least one processor, at least one data storage means and software especially configured and adapted to enable the server to operate, maintain and control a BAS web site. The server also includes a communication interface(s) enabling the server to receive the simplified BAS alarm transmitted by the security monitoring center and re-transmit the alarm to the BAS web site. The server communications interface(s) also is configured and adapted to enable two way communication between the BAS controller and authorized dealers via the BAS web site.

The BAS web site of the present invention is configured and adapted to provide a portal for re-transmission of the simplified BAS alarm to an authorized BAS dealer and to provide the dealer with two-way communication with the BAS controller. The two-way communication provided by the website to the dealer enables the dealer to access and download detailed BAS sensor and control data stored within the data storage means of the BAS controller while also enabling the dealer to upload digital data to the controller.

The BAS authorized dealer of the present invention includes a computer equipped with a communications interface, such as, for example, an interface including a web browser enabling two-way communications between the dealer's computer and the BAS web site. As discussed above, such two-way communication enables the dealer to: 1. receive simplified BAS alarm transmitted via the website; 2. access detailed BAS data related to the alarm stored within the data storage device of the BAS controller (thereby enabling the dealer to diagnose and respond to conditions causative of the alarm); and 3. Upload digital data to the BAS controller in order to remotely control monitored devices, alter software algorithms or over-ride software device control for desired periods of time.

The building automation system of the present invention provides for the generation of a simplified BAS (energy) alarm upon the reception of sensor data uploaded to the BAS controller indicating the occurrence of the afore-mentioned beyond acceptable device operation or environmental condition parameters. In the first preferred embodiment of the present invention, the simplified BAS alarm is transmitted from the BAS controller to a local security panel (as described in greater detail below).

The security panel re-transmits the simplified BAS alarm to a security monitoring center, which, upon receipt of the simplified BAS alarm, simply re-transmits the alarm to the BAS web server. The web server, in turn, transmits the simplified alarm to an authorized dealer via the BAS website operated, managed and controlled by the server via, for example, an e-mail directed to the dealer's email address, dealer's website and/or a work order displayed at the BAS website. The dealer, alerted as to the occurrence of the alarm, is then able to utilize the two-way communication provided by the website to communicate with the BAS controller in the building reporting the alarm, to download detailed data related to the alarm which is analyzed by trained BAS technicians. Thereafter, the dealer may, as appropriate, utilize the two way communication to alter BAS software, remotely control devices, or alter software located within remote control nodes. All embodiments of the present invention also contemplate that dealer clients—owners or managers of the monitored buildings—may also access the BAS website in order to monitor and control the BAS systems located in their respective buildings. The dealer may also utilize the two-way communication to perform routine maintenance of BAS controller software such as, for example, alterations in BAS controller and, in some embodiments, remote node software, in order to improve building efficiency. Also, the dealer is able to remotely determine, by analyzing detailed BAS data, when routine device maintenance should be performed (and to see to it that such maintenance is performed).

The remotely monitored and operated building automation system, of the present invention, is able to advantageously utilize existing security monitoring centers as a simple and cost effective means of receiving and transmitting simplified BAS alarms. The afore-mentioned transmission of only a simplified BAS alarm to such pre-existing monitoring services facilitates integration of the present system into existing monitoring services without the need for extensive training of personnel. In addition, such integration does not require the installation of new hardware/software systems at such monitoring installations as the same modes of transmission ordinarily used to receive security alarm codes from security customers (telephone modems, cable modems, wireless transmission) may be utilized to transmit simplified BAS alarms to the monitoring center. The center may then utilize, for example, Internet transmission of the simplified BAS alarm to transmit the data to the remote BAS web server. Specialized personnel located at the authorized dealer, familiar with BAS diagnostics, operation and intervention, are thus efficiently utilized to access the detailed BAS information associated with such alarms via the BAS web site and are not necessary for the staffing of 24 hour monitoring centers. Such staffing is most efficient in that alarm monitoring personnel are engaged in simple monitoring functions and highly trained BAS technicians are utilized solely when intervention of such personnel is necessary.

The second preferred embodiment of the present invention, as disclosed in detail below, discloses transmission of the simplified BAS alarm directly from the BAS controller to the security monitoring center—without necessarily utilizing a local security panel—. In the second preferred embodiment, the simplified BAS alarm transmitted by the BAS controller includes data indicating—as in the first embodiment—only that an energy alert has issued and the origin of the alarm. Other than the direct transmission of the simplified BAS alarm from the BAS controller directly to the security monitoring center, the first and second embodiments include like elements and components.

The present invention also discloses the above and below described BAS controller especially configured and adapted to generate a simplified BAS alarm in response to reception of sensor data indicating conditions beyond programmed parameters and including remote, two way offsite communication of detailed BAS data.

In addition, the present invention discloses the above and below described security control boards especially configured and adapted to receive and recognize the simplified BAS alarm and to retransmit same as an electronically coded signal indicating an energy alert to an offsite monitoring center.

DETAILED DESCRIPTION OF THE PREFERRED EMBODIMENT

Figure 1:
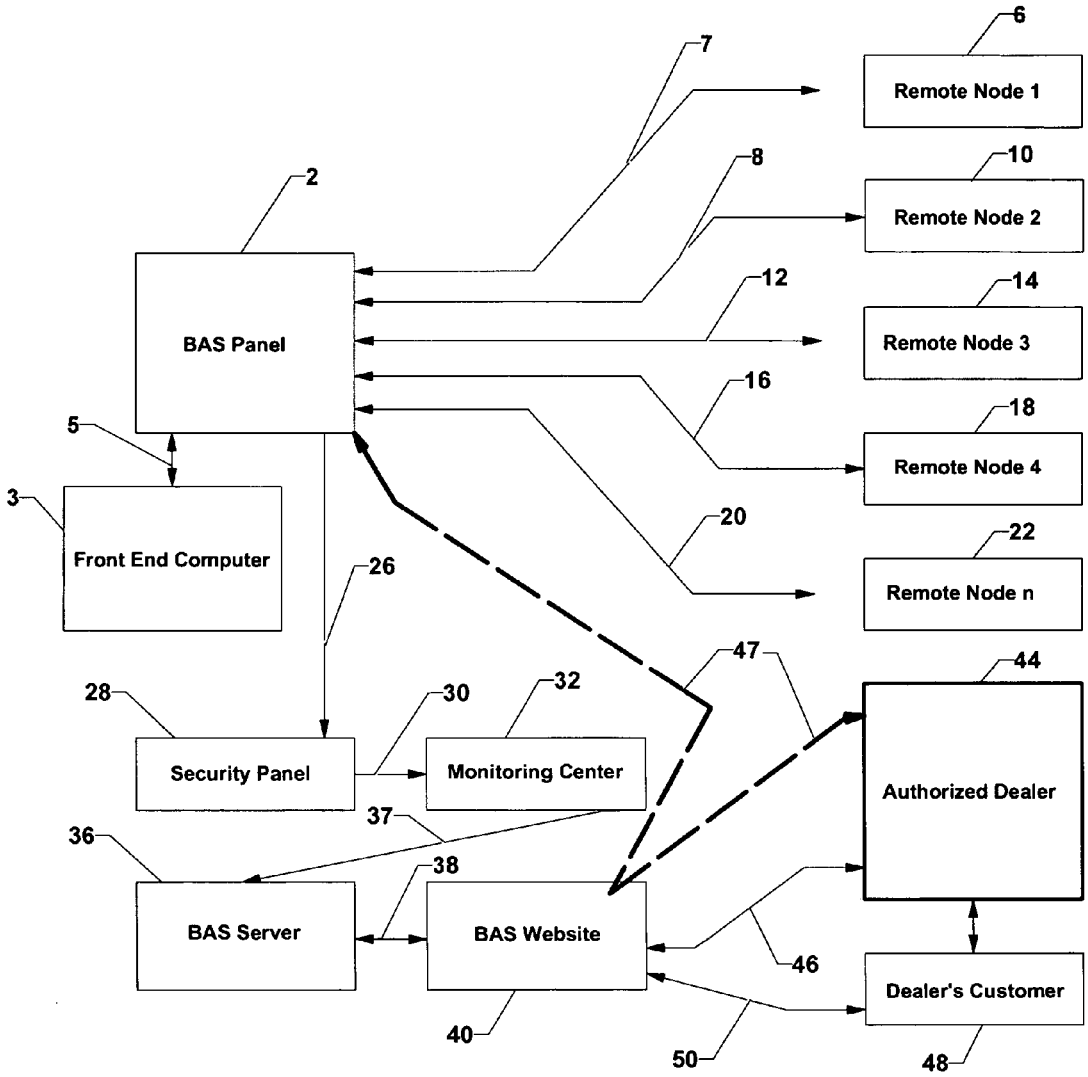
FIG. 1 is a schematic drawing representative of the first preferred embodiment of the remotely managed and controlled building automation system of the present invention.

Like BAS controllers of the past, the controller utilized in accordance with the present invention includes a computer processor, data storage means, power supply and a remote node communications interface. The power supply may comprise an integrated transformer coupled with a connection to local line electricity (building electric power) and/or a battery back up system such as, for example, a UPS (uninterrupted power source). The data storage means may, for example, be comprised of RAM or hard disc drive(s) having sufficient capacity so as to enable storage and retrieval of BAS data. Such BAS controllers are well known to the art and include, for example, such devices as the Mach 1 manufactured by Reliable Control Systems of Victoria, British Columbia, Canada.

BAS controllers especially configured and adapted for practicing the present invention differ from those of the past in that they include software and hardware which enables such master panels to:

1. transmit a simplified BAS alarm signal—via a security (fire/life/safety) panel or directly via a dedicated modem (or other communications interface)—to a remote, offsite alarm monitoring center; and
2. provide two-way remote communication between the BAS controller and, for example, a BAS dealer (staffed with trained BAS technicians) so as to provide remote, off site access to detailed BAS data stored within the controller database. Such bi-directional communications capability also allows remote control of BAS controller software as well as devices monitored and controlled by the BAS system.

Such remote functionality obviates the need for local communication interfaces of the past which enabled bi-directional communication between BAS controllers and on premises front end computers operated by costly, onsite BAS technicians. The monitoring and analysis of complex BAS data, response to BAS alarms, reconfiguration of BAS software, intervention in device control afforded by such onsite management in the past is thus provided remotely, by the BAS dealer.

In regard to BAS systems wherein remote nodes include local device control functions, control of such nodes, including changes in node software (ordinarily resident in ram devices as discussed below) can now be effected from a remote, offsite location. Although a local front end computer may be utilized with master panels configured and adapted for practicing the present invention, such computers are not necessary for system operation.

BAS controllers, especially configured and adapted in accordance with the present invention, include, in addition to a remote node communications interface (for uploading and downloading data to remote nodes), at least one alarm communications interface for transmitting a simplified BAS alarm to a local security control board—or in certain preferred embodiments, directly to a security monitoring center. The brevity of the simplified BAS alarm, and the diminutive amount of data bytes involved (typically, 8 bit), allows the security control board (or in the second preferred embodiment, a BAS controller) to utilize a simple telephone modem (with associated communication software) to transmit the simplified BAS alarm to a security monitoring center. However, the present invention also contemplates alarm communication interfaces utilizing high speed fiber optic or copper cable (such as a DSL), hardwired, or wireless technology.

In the first preferred embodiment of the present invention, the master panel is especially adapted and configured so that the alarm communications interface transmits a simplified BAS alarm to a local security panel (most commonly located in the same building or building complex as is monitored and controlled by the BAS.) More specifically, BAS software is especially adapted to generate a generic alarm—the simplified BAS alarm—when any monitored BAS condition exceeds acceptable device operation or environmental condition parameters. In such instances, the master panel is programmed via, for example, an electrically erasable programmable read-only memory (EEPROM), to generate a simplified BAS alarm to the security panel. The simplified BAS alarm generated by the BAS controller may, for example, comprise nothing more than a simple energy pulse.

The security panel of the present invention is configured and adapted to receive the simplified BAS alarm in the same manner as if a simple alarm sensor (such as an ordinarily open or closed switch) has been tripped—the switch having the address "BAS alarm" or "energy alarm"—. More specifically, a sensor interface location (such as electric/magnetic contact(s)) selected upon the security control board to be utilized for the simplified BAS alarm is electronically coded to read, upon receipt of the BAS alarm, "energy alert" or, for example, "BAS alert". Security panels such as, for example NAPCO, Gemini 3200 Made by NAPCO Security Products of Amityville N.Y. are easily configured and adapted for receipt and transmission of the simplified BAS alarm.

As discussed immediately above, the BAS controller transmits the simplified BAS alarm to a local security panel utilizing an alarm communications interface. In many instance, this interface may simply comprise a hard wired connection between the security panel and the master panel. However, the present invention contemplates the use of any effective local communications means such as, for example, a local building network, an isolated security/BAS network, modulated building electric system or wireless communication system to carry the simplified BAS alarm signal to the security panel.

Upon receipt of a BAS signal, the security panel transmits the simplified BAS alarm signal to the security monitoring center (as the switch position on the security board has been coded, for example, "energy alarm") providing such centers with information indicating that a BAS alarm has been transmitted from a specified building. In certain preferred embodiments of the present invention, the security monitoring centers include especially configured and adapted monitoring software that allows for automatic receipt of a simplified BAS alarm from a security control panel followed by automatic re-transmission of the alert to the BAS web server.

BAS controllers configured and adapted in accordance with the present invention include at least one remote communications interface enabling the master panel bi-directional (two-way) communication via a BAS web site, with remote off site users (discussed below). The remote BAS communication interface(s) advantageously comprise a modem and associated software enabling telephone line, high speed cable (copper or fiber optic), or wireless communication between the master panel and the BAS web site. The at lease one remote communications interface enables detailed BAS data to uploaded via the web site from the master panel as well as allowing uploading data via the web site to the BAS controller. In addition, and as described in more detail below, the interface enables remote, off site control of BAS software, devices and remote nodes.

BAS controllers are typically provided with automated logic enabling master panel control of monitored devices. More specifically, the BAS master panel processor is programmed with building maintenance data and parameters enabling the processor to recognize and respond to remote node data uploaded to the master panel indicating the need for intervention (out of range conditions). Data provided by a remote node indicating the need for intervention might comprise, for example, an "out of range temperature", pressure or other condition. The term "out of range" refers to values which are beyond a BAS software programmed range within the processor (via BAS software) of the BAS master panel (and/or remote nodes, as discussed below). Upon receipt of an out of range signal uploaded to the panel by a remote node, the BAS controller may, in accordance with programming, upload command signals to the remote node to utilize, when equipped, a remote node control board or relay in order to effect changes in device operation. In embodiments of the present invention wherein the remote nodes are not equipped with control boards or relays enabling monitored device control, the master panel includes or may interface directly with control boards or relays controlling monitored devices to effect desired changes.

The term "SIMPLIFIED BAS ALARM" as utilized throughout this specification and within the claims, refers to a data transmission indicative of the occurrence of an unspecified event in which a BAS monitored device or environmental condition has exceeded acceptable parameters and the identity of the building from which the alarm originated. The remotely monitored and controlled building automation system of the present invention transmits the simplified BAS alarm a. via the afore-mentioned alarm communications interface directly to a remote security monitoring service; or
b. via the alarm communications interface to a securing panel which, in turn, transmits the simplified BAS alarm to the security monitoring service.

Security monitoring centers such as Security Central of Statesville N.C. and C.O.P.S. located in Williamstown N.J. are well known and have, in the past, provided remote monitoring concerning client fire/life/security systems. However, in accordance with the present invention, such security monitoring services may now also be utilized to remotely monitor BAS systems for alarms. In certain preferred embodiments of the present invention, such centers may advantageously be especially adapted and reconfigured by means of customized changes to their monitoring software so as to enable recognition, receipt and retransmission of the simplified BAS alarm. However, the present invention does not require security monitoring personnel to have advanced BAS technical training. In addition, the present invention obviates the need for placement of such technicians within each monitored building. As discussed below, highly skilled and trained BAS technicians, in a central office, remote from monitored buildings, are advised of such alarms via a BAS web site maintained, managed and controlled by a BAS web server.

The one or more remote node(s) utilized in accordance with the present invention are well known to the art and are included in building management systems such as, for example, the MACH 1 system of Reliable's, or the Johnson Controls Metasys Building Management system. Such remote nodes are typically provided with a power source, at least one sensor for monitoring a BAS condition—the operational status of a particular device or an environmental condition (e.g. temperature, humidity, air quality) of a specified building area, a processor for receiving data provided by the sensor(s) and a communication means for transferring data obtained by said sensors to the master panel. The node power supply may comprise a transformer in combination with a buildings electric supply. In addition, such power supplies may also comprise a battery back-up. The data provided by the remote node to the master panel is uploaded to a database stored within the data storage means of the master panel.

Remote nodes may, as described below, include computer processors, RAM, software and local device control means enabling such nodes to locally control device function in response to data provided by nodes sensors. In other instances, remote nodes may upload device (or area) conditions to the BAS master panel wherein the master panel processor, software and control means (controller board or relays) may be utilized to control a monitored device. The present invention may incorporate remote nodes enabling direct control of the devices they monitor and/or remote nodes not providing such functions. However, regardless of the type of node incorporated, sensor data and device control data is provided to and stored within the master panel for remote access.

In embodiments of the present invention utilizing remote nodes not incorporating device control boards and/or relays, remote nodes provide sensor data to the BAS master panel through local building network, direct (hard wired) or wireless means. It is also contemplated that remote nodes utilized in practicing the present invention may utilize a node communication interface enabling the transmission of data through a building's electrical wiring. Upon downloading of remote node data, the processor(s) within the master panel compares such sensor data with device data stored within the master panel data base via software algorithms. If data provided by a remote node indicates, upon comparison with such device data, that alteration (including activation or termination) of device operation is required, the BAS master panel effects same utilizing the afore-mentioned controller board and/or relays to achieve such changes in device operation. A simplified BAS alarm is not generated under such circumstances.

As stated above, embodiments of the present invention may also incorporate remote nodes enabling local control of the device(s) monitored. Such control enabled remote nodes may, for example, utilize integrated programmable memory (ram), device control software and a means for effecting control of the device(s) monitored. Such control means may comprise, for example, a device control board and/or relays. In addition, control enabled nodes include software and device operation data, most often stored on ram, which allows the node processor to properly respond to sensor data (or, in some instances, temporally) by turning on, turning off, or otherwise adjusting the device monitored by the node.

Remote nodes having local control functions—having the ability to control the devices they monitor—include software allowing the node processor to utilize target device operational specifications stored within the node's data storage means (e.g., ram) and compare same with data provided by node sensor data input. Such comparisons, made utilizing algorithms within stored node software, are utilized by the node to control the associated device so as to achieve device parameters (and often environmental control goals). Such operational specifications include, for example, acceptable ranges of temperature, pressure, flow, humidity, temporal activity). Remote nodes having such control functions are well known to the art, are fully compatible with the present invention, and include Automated Logic's M-Line, S-Line and EGR components, 1150 Roberts Blvd., Kennesaw, Ga., 30144, USA.

In embodiments of the present invention wherein the remote nodes function as remote control nodes—wherein such nodes comprise local processors, ram and a local device control board—node sensor information is still uploaded to and stored within the master control board. In addition, node control board (or relay) activity may also be stored within the master panel database.

As discussed above, in practicing the first preferred embodiment of the present invention, upon downloading remote node data indicating a device or environmental condition has been detected which is beyond acceptable device operational or environmental condition parameters, the processor within the BAS controller transmits a simplified BAS alarm, via, for example a dry contact closure to a local, especially configured and adapted security control board. The security board, receiving the alarm at a switch position coded "energy alarm" or "BAS alarm" thereafter re-transmits the alarm to a central security monitoring center. The security monitoring center re-transmits the alarm via, for example, the Internet, to a building automation system server which is utilized to receive all such simplified BAS alarms. The BAS web server is comprised of at least one high capacity hard disc storage device, at least one computer processor, keyboard interface with keyboard, and a communication interface. For example, a Dell Dimension 2400 may easily be configured as a BAS web server in accordance with the present invention. The server keyboard and keyboard interface enables control of the server, as well as the BAS web site. The communications interface enables the server to download and store the simplified BAS alarm provided by the security monitoring center as well as transmit the alarm through the BAS web site maintained by the server. The server communications interface may comprise a high speed cable modem (copper or fiber optic), a telephone modem, wireless modem or any other communications hardware—and associated communication software—allowing the server communication with the security monitoring center and two-way communication with the Internet.

The server stores the simplified BAS alarm data within its own data base and thereafter transmits, via the Internet, data indicating that the simplified BAS alarm has occurred to a dedicated BAS web site maintained by the server. The specific remote node and condition which resulted in the alarm are not included in the communication from the server to the BAS web site.

In certain preferred embodiments of the present invention, the BAS web server includes Computerized Maintenance Management Software (CMMS) which enables the server to provide management assistance to dealers and clients. For example, upon receipt of a simplified BAS alarm by the server, the CMMS software creates and causes a work order to be uploaded to the BAS website as a posted alert for a responding Dealer (as well as tracking by the client). The CMMS also facilitates the provision of organized and scheduled preventative Maintenance and service as needed or specified for the monitored building devices by providing dealers with such information through the BAS website.

In practicing the present invention, the BAS web site is maintained in order to provide both clients and authorized dealers/service providers with notification of simplified BAS alarms and remote controlled access to BAS controllers. More specifically, the BAS web site, maintained by the server, allows bidirectional communication between the master panel of each building serviced by the system and authorized users of the web site such as authorized dealers and dealer clients. As discussed above, the master panel, although generating only simplified BAS alarm signals to the securing monitoring center, stores detailed BAS data. Such data includes, for example, data indicating which specific remote node (and associated device or environmental condition) resulted in a given simplified BAS alarm, what the condition associated with the alarm was (e.g. over/under temperature) and control action, taken by the BAS, (either through the remote node or master panel) if any, in response to the condition. The BAS web site may be utilized as a portal to retrieve such detailed BAS data from a selected master panel and thereafter provide same to authorized web site users. Such data is also available through the BAS web server via, for example, a keyboard. Access is also provided through the BAS website to sensor data such as alarm conditions history, trend logs of performance data etc., stored in any monitored BAS controller's database thereby allowing remote analysis of building device operation, environmental control and energy efficiency.

In certain preferred embodiments of the present invention, authorized users are required to utilize an IP address, user I.D. and password in order to enable access and operation of the afore-mentioned web site functions and thus access to the location and system at the specific site where the energy alert originated. In addition, the bidirectional communication between authorized users and each associated master panel enabled by the web site allows authorized dealers, or in certain embodiments, a customer, to remotely control BAS controlled devices or make changes to the programming of the master panel and/or remote nodes. The terms "ENERGY ALERT" and "SIMPLIFIED BAS ALARM" as utilized throughout the specification and within the claims are interchangeable and equivalent terms, both referring to BAS alarms providing only data indicating that a monitored condition has exceeded BAS parameters and the specific premises from which the alarm originated.

In those embodiments of the present invention incorporating remote nodes having local processors, addressable memory (such as, for example, ram), and control boards/relay control of device operation, the web site may also be utilized by dealers and customers to download programming to such nodes as well as to the BAS controller. Thus, BAS technicians may remotely analyze a BAS system, adjust programming within controllers as well as nodes, and thus tune such systems for improved efficiency from an offsite, centralized location.

Upon receipt of a simplified BAS alarm associated with a particular client and building, the BAS web site transmits, for example, via the Internet and wireless technology, Beeper, Nextel or Text message, the simplified BAS alarm to an authorized dealer. A communication may also sent in the form of an email communication accessed by a dealer's computer, or sent to a dealer web site maintained and controlled by a dealer server. Upon receipt of the simplified BAS alarm, the dealer may communicate with the BAS web site and request detailed BAS information from the BAS system which generated the subject alarm.

The BAS web site and server of the present invention enables, in regard to an authorized dealer/BAS service provider:

1. automatic notification of BAS alarms;
2. access to detailed BAS data related to any given BAS alarm—such data being stored within the database of a master panel located in the building from which such BAS alarm originated—thereby enabling such provider to diagnose the condition which resulted in such an alarm and take appropriate action; and
3. access to all BAS data stored within the data base of a client's master panel thereby enabling such provider to provide preventive maintenance and improve building efficiency thereby; and
4. adjustments deemed necessary to building devices controlled by remote nodes incorporating local control boards.

Dealer personnel are able to remotely monitor individual master panels in view of supervising periodic maintenance of the devices monitored by the systems e.g. required changing of filters, replacement of pumps, etc. Furthermore, the dealer personnel are able to access local master panels in order to re-set values and acceptable operating ranges for the devices integrated and controlled by the BAS system in accordance with.

The first preferred embodiment of the present invention is illustrated in FIG. 1, a schematic representation. BAS controller 2 located in a monitored building, includes a computer processor, BAS software, data storage means, remote node interface, alarm communications interface and a power supply. Remote nodes 6, 10, 14, 18 and 22 are positioned within the building. Each node includes a processor, power supply and communications interface allowing communication between the nodes and the BAS controller. The nodes are equipped with at least one sensor in order to monitor devices and areas proximal to the sensors. The nodes may also advantageously include software, processors and control boards/relays in order to enable local control of monitored devices in accordance with sensor input. Such control functions are ordered, when necessary by local node processors after comparing sensor data with stored target values in accordance with RAM stored algorithms. Regardless of the type of remote node (having or not having local control functions) sensor data is transmitted by the remote nodes to the BAS controller via a node communications interface utilizing hard wired, wireless or local network means 4, 8, 12, 16 and 20. When node data received by the BAS controller indicates the existence of a condition beyond acceptable (device or environmental) parameters—as determined by the controller processor by comparing sensor data with stored acceptable parameter ranges and algorithms—, the BAS controller transmits a simplified BAS alarm. In the first preferred embodiment, the simplified BAS alarm is transmitted, via the BAS controller alarm communications interface, to a security panel (security control board) 28 positioned within the same premises. It should be noted that a front end computer 3 having two-way communication 5 may be utilized in practicing certain embodiments of the present invention, but such devices certainly are not required. The BAS controller may incorporate an alarm communications interface which simply utilizes a hard wire line 26 in order to transmit the BAS alarm as a simple pulse to the security panel. For example, the wire may be connected to a switch terminal, located upon the security control board, in substantially the same manner as window, door and other security sensors are connected. However, the switch position to which the BAS alarm pulse is sent is especially coded to read "energy alarm" or "BAS alarm." Simply put, the security panel 28 thus "reads" the simplified BAS alarm transmitted by the BAS controller as an activated switch with the address "BAS alarm" or "energy alarm". However, the BAS controller can be configured and adapted to transmit the simplified BAS alarm to the security panel via any communications interface required by the particular security controller board utilized. For example, if the security panel utilizes wireless sensor technology, the BAS controller is configured and adapted to transmit a wireless digital signal to the security control board. The security control board is configured to recognize the digital signal sent by the BAS panel in the same manner as alarm signals from any other security sensor—but having the address "energy alert" or "BAS alarm"—.

Upon receiving the BAS alarm from the BAS controller, the security panel utilizes a communications interface to transmit the alarm to a security monitoring center 32. The security panel may incorporate a communications interface utilizing a simple telephone modem and telephone line 30 means to transmit the alarm to the security monitoring center. In the alternative, the security panel may utilize any type of communications interface such as, for example, wireless, high speed cable (copper or fiber optic) as a direct conduit or Internet access in order to transmit the simplified alarm to the security monitoring center. Upon receipt of the simplified BAS alarm, (which, as stated above, "reads" electronically as an energy/BAS alarm), the security monitoring center 32 simply retransmits the alarm to a BAS web server 36 via a communications interface utilizing, for example, telephone line, high speed cooper, fiber optic or wireless technology 37. The security monitoring center may utilize, for example, a communications interface enabling the use of telephone, high speed cable (copper and fiber optic), or wireless technology—as a direct conduit or to provide Internet access—. The BAS web server 36 which is utilized to configure, manage and control a BAS website 40 upon receipt of the simplified BAS alarm, transmits same to the BAS website 40 via a two-way communications interface with the Internet such as, for example, high speed copper/fiber optic cable means 38. The simplified BAS alarm is thus displayed, for example, as a work order for a particular building site. The simplified BAS alarm may also be re-transmitted as, for example, an email to a BAS dealer 44. A computer, operated by the dealer (and trained BAS technicians thereof), provides access to download the simplified BAS alarm (work order) displayed upon the BAS web site. Also, the dealer may, for example, access email communications containing the simplified BAS alarm data transmitted by the BAS server, or, for example, via the BAS website to the dealer. However, regardless of the means of delivery, the dealer initially receives data indicating only that an energy alarm has originated from a particular (identified) building.

The BAS dealer may utilize the BAS website 40 to achieve two-way communication 46 with the BAS controller originally issuing the alarm so as to obtain detailed data related to the subject alarm. In addition, the two-way communication afforded by the website enables BAS technicians—at any time—to make adjustments to BAS controllers and/or remote node software in order to optimize building efficiency and to order maintenance for monitored devices by utilizing the web site as a 2 way communications portal 47 between the dealer and a selected BAS controller. In addition, the website 40 may be accessed by dealer's, clients 48—individuals and/or entities having ownership, management or other responsibilities for a monitored building—via client communication interfaces 50. Such interfaces comprise Internet communications interfaces utilizing for example, telephone modem, high speed cable (copper and fiber optic) and wireless technologies. Such access allows clients the same two-way communication with BAS controllers within their buildings and thus to perform some or all of the functions performed by the dealer through his BAS technicians.

Figure 2:
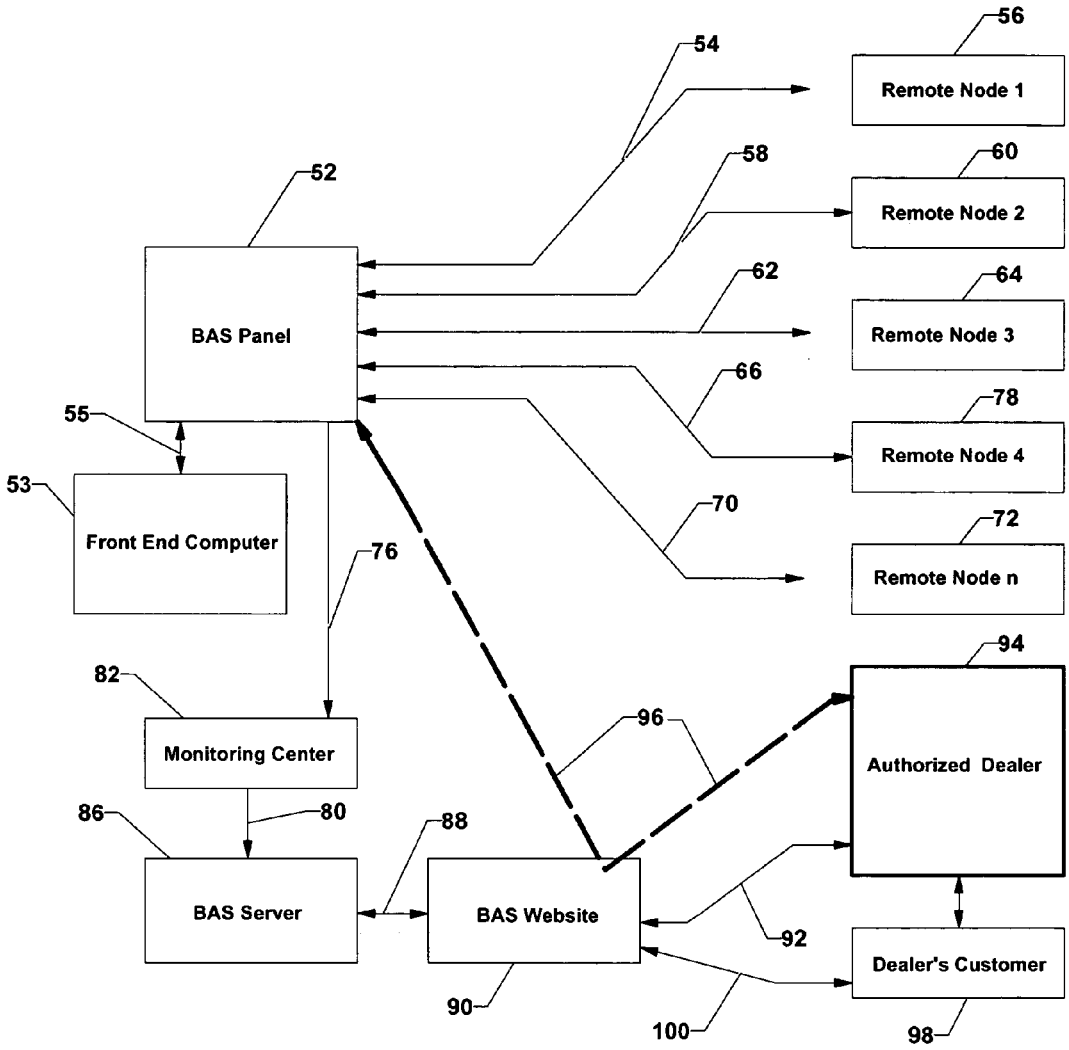
FIG. 2 is a schematic drawing representative of the second preferred embodiment of the remotely managed and controlled building automation system of the present invention.

The second preferred embodiment of the present invention is illustrated in FIG. 2, also a schematic representation. BAS controller 52 located in a monitored building, includes a computer processor, BAS software, data storage means, remote node interface, alarm communications interface and a power supply. It should be noted that a front end computer 53 having two-way communication 55 may be utilized in practicing certain embodiments of the present invention, but such devices certainly are not required. Remote nodes 56, 60, 64, 78 and 72 are positioned within the building. Each node includes a sensor, processor, power supply and communications interface allowing communication between the nodes and the BAS controller. The nodes are equipped with at least one sensor in order to monitor devices and areas proximal to the sensors. The nodes may also advantageously include software, processors and control boards/relays in order to enable local control of monitored devices in accordance with sensor input. Such control functions are ordered, when necessary, by local node processors after comparing sensor data with stored target values in accordance with RAM stored algorithms. Regardless of the type of remote node (having or not having local control functions) sensor data is transmitted by the remote nodes via a node communications interface utilizing hard wired, wireless or local network means 54, 58, 62, 66 and 70. When node data received by the BAS controller indicates the existence of a condition beyond acceptable (device or environmental) parameters—as determined by the controller processor by comparing sensor data with stored acceptable parameter ranges and algorithms resident within BAS software—, the management controller transmits a simplified BAS alarm. In the second preferred embodiment, the simplified BAS alarm is transmitted, via the alarm communications interface, directly to a security monitoring center 82 located offsite. The BAS management controller incorporates an alarm communications interface, such as, for example, a simple telephone modem and telephone line 76 in order to transmit the BAS alarm to a security monitoring center. However, the BAS controller may also employ a direct line, wireless, high speed fiber optic and high speed copper technology as an alarm communications interface to transmit the simplified BAS alarm to the security monitoring center. However, regardless of the conduit utilized, the signal transmitted to the security monitoring center comprises only an energy alarm—data indicating a simplified BAS alarm has issued and the location from which it was sent—.

Upon receiving the BAS simplified BAS alarm transmitted from the BAS controller (which, as stated above, "reads" electronically as an energy/BAS alarm), the security monitoring center 82 simply retransmits the alarm to a BAS web server 86. The security monitoring center may utilize, for example, a communications interface enabling the use of telephone, high speed cable (copper and fiber optic), or wireless technology 80—as a direct conduit or to provide Internet access—. The BAS web server 86 which is utilized to configure, manage and control a BAS website 90 upon receipt of the simplified BAS alarm, transmits same to the BAS website 90 via a two-way communications interface with the Internet such as, for example, high speed copper/fiber optic cable means 88. The simplified BAS alarm may, in certain preferred embodiments, be displayed, for example, as a work order for a particular building site. The simplified BAS alarm is also re-transmitted as, for example, an email to a BAS dealer 94.

A computer, operated by the dealer (and trained BAS technicians thereof), provides access to download the simplified BAS alarm (work order) displayed upon the BAS web site. Also, the dealer may, for example, access email communications containing the simplified BAS alarm data transmitted by the BAS server, or, for example, via the BAS website to the dealer. However, regardless of the means of delivery, the dealer initially receives data indicating only that an energy alarm has originated from a particular (identified) building.

The BAS dealer may utilize the BAS website 90 via the dealer's computer's two-way communications interface 92 as a portal to achieve two-way communication 96 with the BAS controller originally issuing the alarm so as to obtain detailed data related to the subject alarm. In addition, the two-way communication afforded by the website enables BAS technicians—at any time—to make adjustments to BAS management controllers and/or remote node software in order to optimize building efficiency and to order maintenance for monitored devices. In addition, the website 90 may be accessed by dealer's clients 98—individuals and/or entities having ownership, management or other responsibilities for a monitored building—via client communication interfaces 100. Such interfaces comprise Internet communications interfaces utilizing for example, telephone modem, high speed cable (copper and fiber optic) and wireless technologies. Such access allows clients the same two-way communication with BAS controllers within their buildings and thus to perform some or all of the functions performed by the dealer through his BAS technicians.

The terms and expressions which have been employed in the foregoing specification are used therein as terms of description and not limitation, and there is no intention, in the use of such terms and expressions, of excluding equivalents of the features shown and described or portions thereof, it being recognized that the scope of the invention is defined and limited only by the following claims.

I claim:

1. A remotely monitored and controlled building automation system comprised of:

a BAS controller especially configured and adapted to generate and transmit a simplified BAS alarm to an offsite location in response to reception of sensor data indicating existence of a monitored condition beyond acceptable parameters, the BAS controller also being especially configured and adapted to provide two way communication of detailed BAS sensor and control data between the controller and a remote, offsite location;

at least one remote node having a processor, power source and at least one sensor especially configured and adapted to monitor building data, and a communications interface enabling data transmission between the node and BAS controller;

a security monitoring center having a communications interface especially configured and adapted to monitor for and receive the simplified BAS alarm generated by the BAS controller, and further configured and adapted to re-transmit the simplified BAS alarm to a server;

a BAS web server having a communications interface, especially configured and adapted to receive the simplified BAS alarm transmitted by the security monitoring center and thereafter display same at a website operated, maintained and controlled by the BAS web server;

a BAS website especially configured and adapted to receive the simplified BAS alarm transmitted by the BAS web server and to thereafter transmit same to a BAS dealer, said website also configured and adapted to provide the dealer with a portal providing two-way communication with the BAS controller;

a BAS dealer having a computer including a communications interface, especially adapted and configured to enable two-way communications between the dealer and the BAS website thereby enabling the dealer to receive the simplified BAS alarm displayed upon, and transmitted by the BAS website as well as to utilize two way communication with the BAS controller via the portal provided by the BAS website.

2. The remotely monitored and controlled building automation system of claim 1 wherein the BAS controller comprises a computer processor, BAS software, data storage means, power supply, alarm communication interface, remote communication interface and a node communication interface.

3. The remotely monitored and controlled building automation system of claim 1 further comprising a security control board wherein, in response to reception of sensor data indicating the existence of a monitored condition beyond acceptable parameters, the BAS controller transmits an alarm signal to the security control board, which, in turn, transmits the simplified BAS alarm to the security monitoring center.

4. The remotely monitored and controlled building automation system of claim 2 wherein the data storage means is selected from the group consisting of RAM and hard disc drives.

5. The remotely monitored and controlled building automation system of claim 2 wherein the BAS controller power supply comprises line electricity.

6. The remotely monitored and controlled building automation system of claim 5 wherein BAS controller power supply further comprises a battery back up system.

7. The remotely monitored and controlled building automation system of claim 2 wherein the node communication interface is selected from the group consisting of hard wired, wireless, local network and modulated electric communications interfaces.

8. The remotely monitored and controlled building automation system of claim 2 wherein the alarm BAS communications interface is selected from the group consisting of hard wired, telephone, high speed copper cable, high speed fiber optic cable and wireless interfaces.

9. The remotely monitored and controlled building automation system of claim 3 wherein the simplified BAS alarm generated by the BAS controller is a simple electronic pulse resulting from a dry contact closure and wherein the pulse is transmitted to a switch position located upon the security control board coded as an energy alarm.

10. The remotely monitored and controlled building automation system of claim 2 wherein the BAS controller remote communications interface is selected from the group consisting of hard wired, telephone, high speed copper cable, high speed fiber optic cable and wireless interfaces.

11. The remotely monitored and controlled building automation system of claim 2 wherein the remote node power source is selected from the group consisting of line electricity, battery power, and a UPS device.

12. The remotely monitored and controlled building automation system of claim 2 wherein the remote node communications interface is selected from the group consisting of hard wired, wireless, local network and modulated electric wiring interfaces.

13. The remotely monitored and controlled building automation system of claim 2 wherein the security monitoring communications interface is selected from the group consisting of telephone, high speed copper cable, high speed fiber optic cable and wireless interfaces.

14. The remotely monitored and controlled building automation system of claim 2 wherein the BAS web server comprises a processor, data storage means and software especially configured and adapted to enable the server to operate, maintain and control the BAS web site.

15. The remotely monitored and controlled building automation system of claim 14 wherein the data storage means comprises a hard disc drive.

16. The remotely monitored and controlled building automation system of claim 15 wherein the server software comprises computerized maintenance management software which enables the server to provide management assistance to dealers.

17. The remotely monitored and controlled building automation system of claim 16 wherein the management assistance provided by said software includes the generation of alarm work orders and maintenance work orders.

18. The remotely monitored and controlled building automation system of claim 2 wherein the server communication interface is selected from the group consisting of telephone, high speed fiber optic cable, high speed copper cable and wireless interfaces.

19. The remotely monitored and controlled building automation system of claim 18 wherein the BAS web server transmits a simplified BAS alarm to the dealer utilizing wireless technology.

20. The remotely monitored and controlled building automation system of claim 19 wherein the wireless technology is selected from the group consisting of beepers, text message devices, or Nextel.

21. The remotely monitored and controlled building automation system of claim 2 wherein access to the BAS web site requires input of an IP address, user name and password.

22. The remotely monitored and controlled building automation system of claim 2 wherein the BAS dealer computer communications interface is selected from the group consisting of telephone, high speed copper, high speed fiber optic and wireless interfaces.

23. The remotely monitored and controlled building automation system of claim 2 wherein access to detailed BAS data is provided to clients.

24. The remotely monitored and controlled building automation system of claim 3 wherein the security control board transmits the simplified BAS alarm received from the BAS controller to the security monitoring center via a security system board communications interface.

25. The remotely monitored and controlled building automation system of claim 24 wherein the security system board communications interface is selected from the group consisting of hard wired, telephone, high speed copper, high speed fiber optic and wireless interfaces.

26. The remotely monitored and controlled building automation system of claim 2 wherein the BAS controller additionally comprises a controller board and software for effecting control of devices monitored by the system.

27. The remotely monitored and controlled building automation system of claim 2 wherein the BAS controller additionally comprises relays and software for effecting control of devices monitored by the system.

28. The remotely monitored and controlled building automation system of claim 2 wherein the at least one remote node additionally comprises a controller board for effecting local control of a device monitored by the node.

29. The remotely monitored and controlled building automation system of claim 2 wherein the remote node additionally comprises relays and software enabling the node to locally control a device monitored by the node without receiving control data from the BAS controller.

30. A remotely monitored and controlled building automation system comprised of:

a BAS controller especially configured and adapted to generate and transmit a simplified BAS alarm in response to reception of sensor data indicating existence of a monitored condition beyond acceptable parameters, the BAS controller also being especially configured and adapted to provide two way communication of detailed BAS sensor and control data between the controller and a remote, offsite location;

at least one remote node having a processor, power source and at least one sensor especially configured and adapted to monitor building data, and a communications interface enabling data transmission between the node and the BAS controller;

a security control board having a communications interface, especially configured and adapted to receive the simplified BAS alarm generated by the BAS controller and thereafter transmit same to an offsite location;

a security monitoring center, having a communications interface, especially configured and adapted to monitor and receive the simplified BAS alarm transmitted by the security control board, and further configured and adapted to re-transmit the simplified BAS alarm to a server;

a BAS web server having a communications interface, especially configured and adapted to receive the simplified BAS alarm transmitted by the security monitoring center and thereafter display same at a website operated, maintained and controlled by the BAS web server;

a BAS website especially configured and adapted to receive the simplified BMS alarm transmitted by the BAS web server and to thereafter transmit same to a BAS dealer, said website also configured and adapted to provide the dealer with a portal providing two-way communication with the BAS controller;

a BAS dealer having a computer including a communications interface, especially adapted and configured to enable two-way communications between the dealer and the BAS web site thereby enabling the dealer to receive the simplified BAS alarm displayed upon, and transmitted by the BAS website as well as to enable utilization of the two way communication with the BAS controller provided by the BAS website.

31. The remotely monitored and controlled building automation system of claim 1 wherein the BAS controller comprises a computer processor, BAS software, data storage means, power supply, alarm communication interface, remote communication interface and a node communication interface.

32. The remotely monitored and controlled building automation system of claim 31 wherein the data storage means is selected from the group consisting of RAM and hard disc drives.

33. The remotely monitored and controlled building automation system of claim 31 wherein the BAS controller power supply comprises line electricity.

34. The remotely monitored and controlled building automation system of claim 33 wherein BAS controller power supply further comprises a battery back up system.

35. The remotely monitored and controlled building automation system of claim 30 wherein the node communication interface is selected from the group consisting of hard wired, wireless, local network and modulated electric wiring communications interfaces.

36. The remotely monitored and controlled building automation system of claim 31 wherein the BAS controller alarm communications interface is selected from the group consisting of hard wired, telephone, high speed copper cable, high speed fiber optic cable and wireless interfaces.

37. The remotely monitored and controlled building automation system of claim 36 wherein the simplified BAS alarm generated by the BAS controller is a simple electronic pulse resulting from a dry contact closure and wherein the pulse is transmitted to a switch position located upon the security control board coded as an energy alarm.

38. The remotely monitored and controlled building automation system of claim 31 wherein the BAS controller remote communications interface is selected from the group consisting of hard wired, telephone, high speed copper cable, high speed fiber optic cable and wireless interfaces.

39. The remotely monitored and controlled building automation system of claim 30 wherein the remote node power source is selected from the group consisting of line electricity, battery power, and a UPS device.

40. The remotely monitored and controlled building automation system of claim 30 wherein the remote node communications interface is selected from the group consisting of hard wired, wireless, local network and modulated electric wiring interfaces.

41. The remotely monitored and controlled building automation system of claim 30 wherein the security monitoring communications interface is selected from the group consisting of telephone, high speed copper cable, high speed fiber optic cable and wireless interfaces.

42. The remotely monitored and controlled building automation system of claim 30 wherein the BAS web server comprises a processor, data storage means and software especially configured and adapted to enable the server to operate, maintain and control the BAS web site.

43. The remotely monitored and controlled building automation system of claim 42 wherein the data storage means comprises a hard disc drive.

44. The remotely monitored and controlled building automation system of claim 42 wherein the server software comprises computerized maintenance management software which enables the server to provide management assistance to dealers.

45. The remotely monitored and controlled building automation system of claim 44 wherein the management assistance provided by said software includes the generation of alarm work orders and maintenance work orders.

46. The remotely monitored and controlled building automation system of claim 30 wherein the server communication interface is selected from the group consisting of telephone, high speed fiber optic cable, high speed copper cable and wireless interfaces.

47. The remotely monitored and controlled building automation system of claim 46 wherein the BAS web server transmits a simplified BAS alarm to a dealer utilizing wireless technology.

48. The remotely monitored and controlled building automation system of claim 47 wherein the wireless technology is selected from the group consisting of beepers, text message devices, or Nextel.

49. The remotely monitored and controlled building automation system of claim 30 wherein access to the BAS web site requires input of an IP address, user name and password.

50. The remotely monitored and controlled building automation system of claim 30 wherein the BAS dealer computer communications interface is selected from the group consisting of telephone, high speed copper cable, high speed fiber optic and wireless interfaces.

51. The remotely monitored and controlled building automation system of claim 30 wherein access to detailed BAS data is provided to clients.

52. The remotely monitored and controlled building automation system of claim 30 wherein the security system board communications interface is selected from the group consisting of hard wired, telephone, high speed copper, high speed fiber optic and wireless interfaces.

53. The remotely monitored and controlled building automation system of claim 31 wherein the BAS controller additionally comprises a controller board and software for effecting control of devices monitored by the system.

54. The remotely monitored and controlled building automation system of claim 31 wherein the BAS controller additionally comprises relays and software for effecting control of devices monitored by the system.

55. The remotely monitored and controlled building automation system of claim 30 wherein the at least one remote node additionally comprises a device controller board and software for effecting local control of devices monitored by the node.

56. The remotely monitored and controller building automation system of claim 30 wherein the at least one remote node additionally comprises relays and software for effecting local control of devices monitored by the node.

* * * * *